United States Patent [19]

Hyzin

[11] Patent Number: 5,052,948

[45] Date of Patent: Oct. 1, 1991

[54] CONNECTOR GROUND AND SHIELD

[75] Inventor: Peter J. Hyzin, El Toro, Calif.

[73] Assignee: ITT Corporation, Secaucus, N.J.

[21] Appl. No.: 615,764

[22] Filed: Nov. 19, 1990

[51] Int. Cl.[5] ..... H01R 13/648

[52] U.S. Cl. ..... 439/607; 439/609; 29/874

[58] Field of Search ..... 439/607, 609, 610, 904; 29/874

[56] References Cited

U.S. PATENT DOCUMENTS

| | | | |
|---|---|---|---|
| 3,136,593 | 6/1964 | Ehrman et al. | 339/222 |
| 3,366,918 | 1/1968 | Johnson et al. | 339/143 |
| 3,521,222 | 7/1970 | Andrews | 339/143 |
| 3,680,033 | 7/1972 | Kawai | 339/46 |
| 3,897,125 | 7/1975 | Anderson | 339/14 |
| 4,106,839 | 8/1978 | Cooper | 339/143 |
| 4,426,127 | 1/1984 | Kubota | 339/177 |
| 4,493,525 | 1/1985 | Hall et al. | 339/143 |
| 4,563,052 | 1/1986 | Dietrich | 339/143 |
| 4,611,878 | 9/1986 | Hall et al. | 339/186 |
| 4,655,533 | 4/1987 | Haag | 339/143 |
| 4,687,263 | 8/1987 | Cosmos et al. | 439/108 |
| 4,699,438 | 10/1987 | Kikuta | 439/95 |
| 4,718,866 | 1/1988 | Yamaguchi | 439/607 |
| 4,738,637 | 4/1988 | Asick et al. | 439/610 |
| 4,812,137 | 3/1989 | Wilson et al. | 439/607 |
| 4,838,810 | 6/1989 | Yoshimura et al. | 439/607 X |
| 4,867,692 | 9/1989 | Kerek | 439/101 |
| 4,878,858 | 11/1989 | Dechelette | 439/607 |
| 4,936,795 | 6/1990 | Kawai et al. | 439/607 X |
| 4,961,711 | 10/1990 | Fujiura et al. | 439/610 X |

*Primary Examiner*—Larry I. Schwartz
*Assistant Examiner*—J. R. Daulton
*Attorney, Agent, or Firm*—Thomas L. Peterson

[57] ABSTRACT

A receptacle connector is described, which has an EMI (electromagnetic interference) shield of low cost construction with many rearwardly-extending tines for engaging a fully mated plug connector and a pair of forwardly extending fingers for grounding the plug connector before contact mating occurs, in a low cost construction. The shield (60) is formed of a piece of sheet metal having an approximately 180° bend (62) resulting in outer and inner legs (66, 64). The outer leg is mounted in a groove (70) on the inside of the connector shell (22), while the inner leg forms multiple tines (50) and a pair of early grounding fingers (80). A region of the inner leg has a pair of vertical slots (84, 86) forming a finger with a rear end (90) supported on adjacent portions of the inner leg and with a free finger outer end (82) that engages a plug connector when it is first inserted into the receptacle connector.

9 Claims, 4 Drawing Sheets

FIG. 1
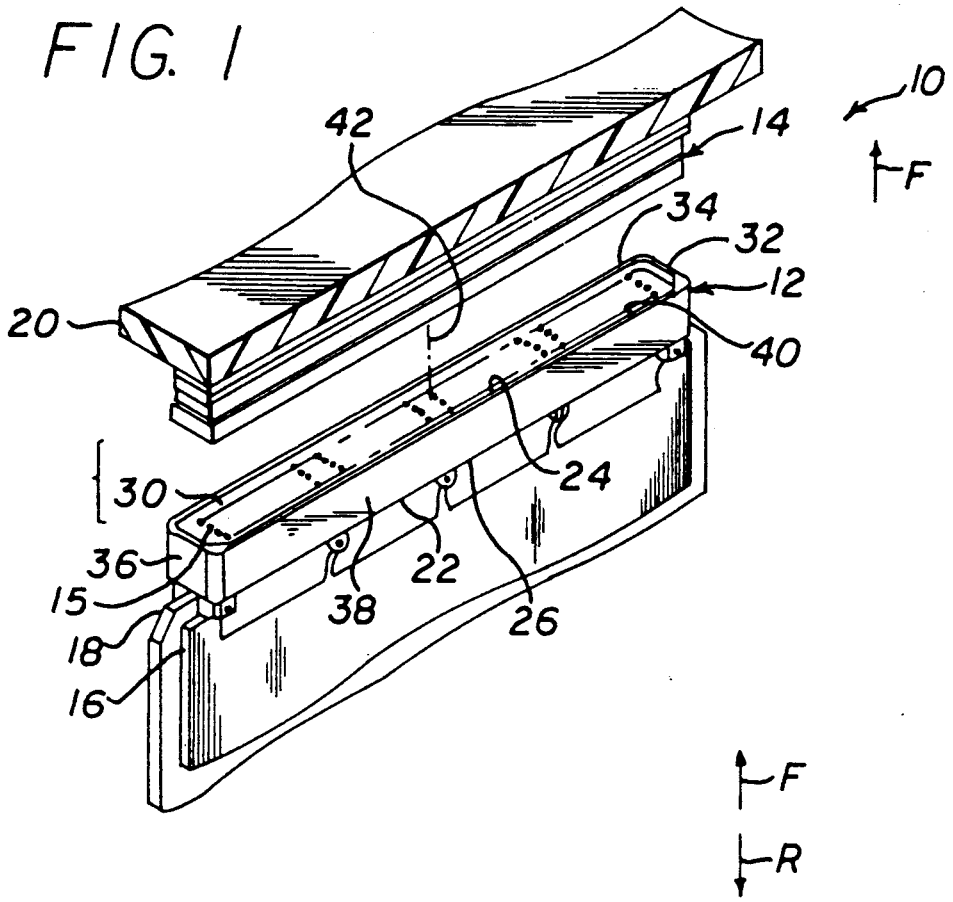
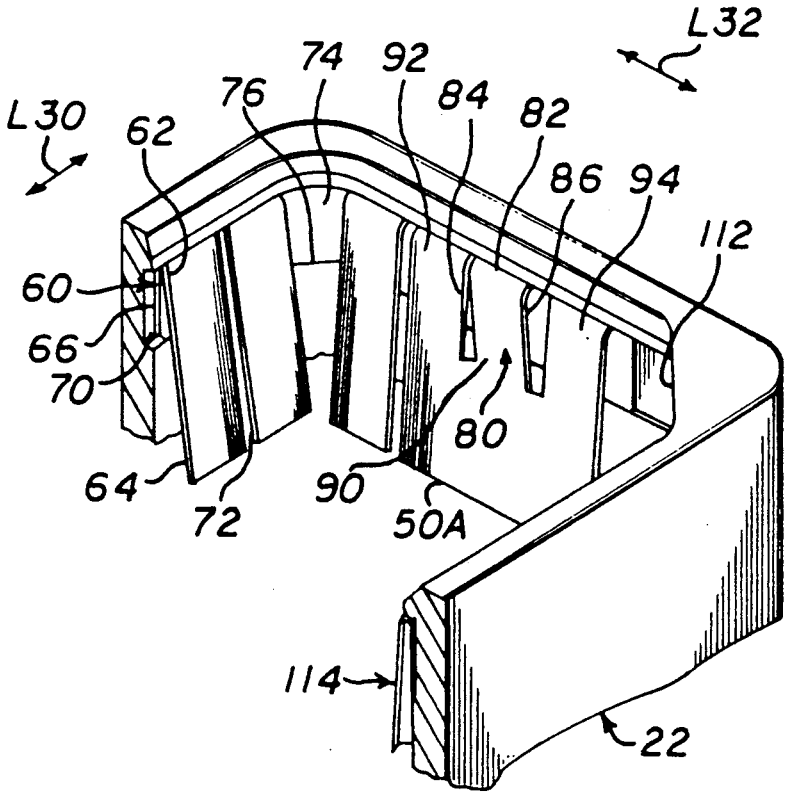
FIG. 3

FIG. 6
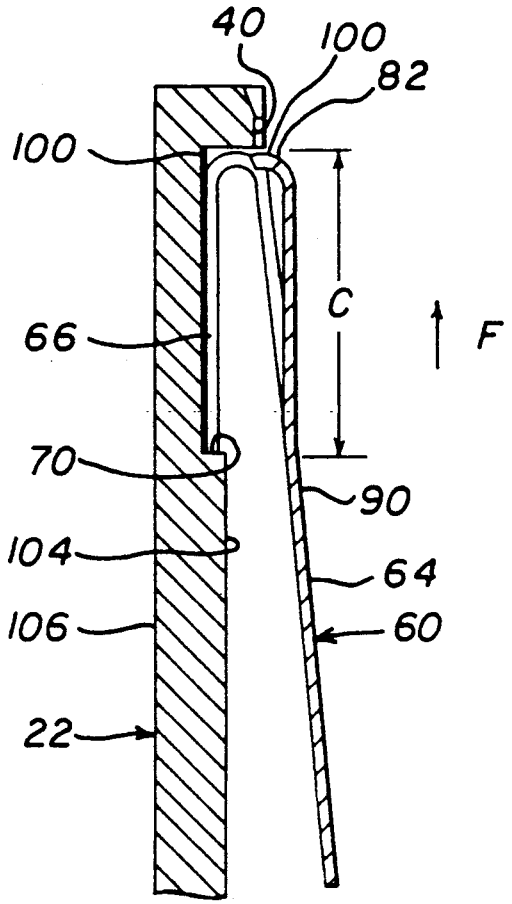
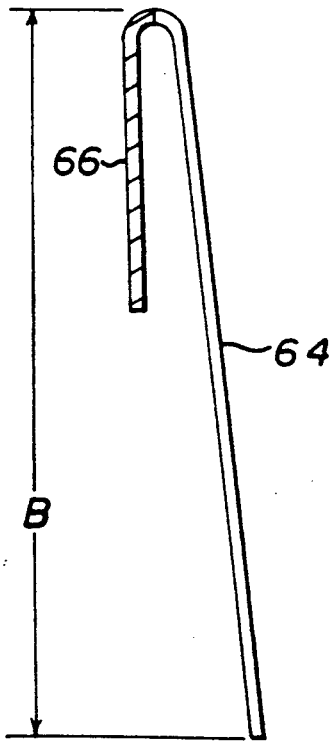
FIG. 7

CONNECTOR GROUND AND SHIELD

BACKGROUND OF THE INVENTION

One type of electrical connector system includes a receptacle connector with multiple contacts lying in an insulative body. A metal shell surrounding the body and contacts can receive a mating plug connector. Where radio interference is a problem, an EMI (electromagnetic interference) shield is desirable to bridge the gap between the metal shells of the connectors. U.S. Pat. No. 4,812,137 describes an interference shield with multiple tines having rearward ends that contact the plug connector as it is inserted in a rearward direction. While such rearwardly extending tines assure reliable low-force contact with the plug connector after it has been inserted about half way, they do not establish contact with a plug connector at the beginning of insertion. It is desirable to establish early contact between the connectors to assure that their shells are at the same ground potential, to discharge any static electrical buildup that may occur on one of the connectors before their contacts begin to mate.

U.S. Pat. No. 3,136,593 describes an electrical connector with an interference shield having fingers that cause engagement of shells of two connectors before the contacts of the connectors start to mate. The fingers extend forwardly to engage the other connector early during insertion. However, forwardly extending fingers do not deflect with as low a force or as reliably as rearwardly extending fingers, so the forwardly extending fingers can increase resistance to mating of the connectors and increase the possibility of damage to the fingers. A connector which provided both EMI shielding and early grounding, with a shield design of high reliability and low cost, would be of considerable value.

SUMMARY OF THE INVENTION

In accordance with one embodiment of the present invention, a connector with an interference shield is provided, wherein the shield provides EMI (electromagnetic interference) shielding between mated connectors as well as grounding of the connectors before their contacts are mated, in a reliable and low cost construction. The interference shield is formed from a piece of sheet metal having a bend of about 180° to form an outer leg mounted on the connector shell and an inner leg with rearwardly extending tines for engaging a mating connector for EMI shielding. The inner leg has slots forming a finger that is shorter than the inner leg. The finger has a rearward end supported on adjacent portions of the inner leg and a forward free end that is bent inwardly and that engages the mating connector before the contacts of the connectors mate.

The novel features of the invention are set forth with particularity in the appended claims. The invention will be best understood from the following description when read in conjunction with the accompanying drawings.

BRIEF DESCRIPTION OF THE DRAWINGS

FIG. 1 is an isometric view of a connector system constructed in accordance with the present invention, with the connectors spaced apart.

FIG. 3 is a partial isometric view of the receptacle connector of FIG. 2.

FIG. 6 is a view of the shield taken on the line 6—6 of FIG. 5, and also including a partial sectional view of a receptacle shell on which the shield can be mounted.

FIG. 7 is a view taken on the line 7—7 of FIG. 5.

DESCRIPTION OF THE PREFERRED EMBODIMENT

Figure 2:
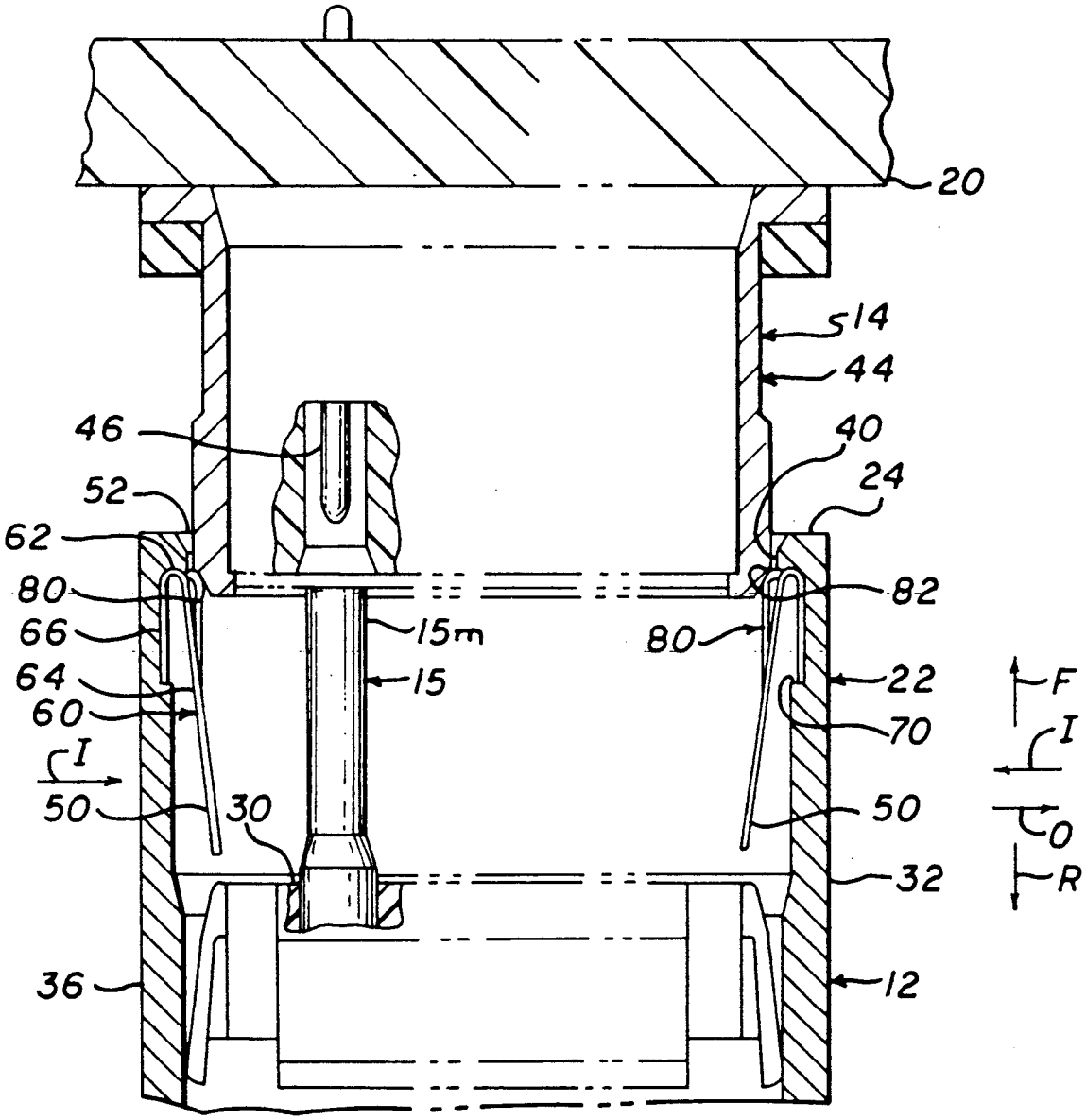
FIG. 2 is a partial sectional view of the connectors of FIG. 1, shown during the beginning of mating.

FIG. 1 illustrates a connector system 10 which includes a receptacle connector 12 and a mateable plug connector 14. The receptacle connector has contacts 15 connected to a pair of circuit boards 16, 18, while the plug connector has contacts connected to another circuit board 20. The receptacle connector has a conductive shell 22 with forward and rearward ends 24, 26. The shell surrounds an insulative body 30 which holds the contacts 15. The front end of the shell is largely rectangular, with four sides 32 - 38 forming a rectangular opening 40 for receiving the plug connector. The connectors can be mated by moving the receptacle connector 12 in a forward direction indicated by arrow F, along a connector axis 42, to receive the plug connector. It may be noted that while the connectors are shown separated in a vertical direction, and such terms as "height" may be used herein to aid in a description of the invention, the connectors can be used at any orientation with respect to gravity.

FIG. 2 shows the connectors 12, 14 as they start to mate, with the plug shell 44 entering the receptacle shell 22. Further forward movement F of the receptacle connector results in the forward mating portion 15 m of each receptacle contact 15 receiving a plug connector contact 46. As the connectors become fully mated, resilient tines 50 on the receptacle connector press against the outside of the plug connector shell 44. The tines serve to block electromagnetic radiation that could enter through the gap 52 between the connector shells.

The tines 50 are part of an interference shield 60 also shown in FIG. 3. The shield is formed from a piece of sheet metal with a bend 62 and with inner and outer legs 64, 66. The outer leg 66 is mounted in a groove 70 of the receptacle shell, with the groove extending along the length dimension L30, L32 of a corresponding shell side or wall 30, 32. The inner leg 64 has several slots 72 that divide the inner leg into several tines 50. In the particular shield shown, one piece of sheet metal extends around three of the sides of the receptacle connector, and includes a shield bent region 74 extending around a curved shell bent groove portion 76.

In addition to the tines 50 which provide shielding for the fully mated connectors, there is a need for early grounding of the shells, before the contacts 15, 46 of the two connectors begin to mate. That is, the shell of one of the connectors may be at ground potential, while the shell of the other connector may be at a far different potential which may be due to electrostatic charge buildup. It is desirable that the shells of the two connectors be connected before their contacts mate to avoid damage to certain sensitive components on one of the circuit boards. Such early grounding is obtained by the provision of grounding fingers 80, which are included in the interference shield. Each of the fingers has a free forward end 82 lying near the opening 40 of the receptacle connector shell, and slightly inward thereof. The fingers engage the plug shell 44 soon after the plug shell enters the receptacle shell, to electrically connect the two shells so they are at the same potential prior to mating of the contacts.

Each grounding finger 80 is formed from the same sheet metal as one or more adjacent tines 50. The finger is formed by providing an especially wide tine 50A, and by forming a pair of "vertical" slots 84, 86 in the tine, that is, slots extending in forward and rearward direction F and R. The free forward end 82 of the finger is also free of adjacent portions of the shield. The lengths of the slots 84, 86 is much less than the length of the inner leg 64 of the shield; as a result, the rearward end 90 of the finger is supported by and is integral with, adjacent portions of the wide tine 50A. Also, the finger 80 is bent so its free forward end 82 lies inward (in the direction I towards the connector axis 42) of adjacent first and third parts 92, 94 of the wide tine. The result of this construction is that a grounding finger 80 is provided that is integral with the rest of the shield which includes the EMI shielding tines.

The early grounding fingers 80 serve to block the space between connector shells from electromagnetic radiation. However, it is desirable that most of the EMI shielding be obtained from the tines which extend primarily in a rearward direction along arrow R, with a small inward directional component I. Such rearwardly-inwardly extending tines are fault-tolerant, and will be deflected by the inserted plug shell even if there is slight damage to the tines which causes them to be misbent. Accordingly, applicant uses only two early grounding fingers 80.

Figure 4:
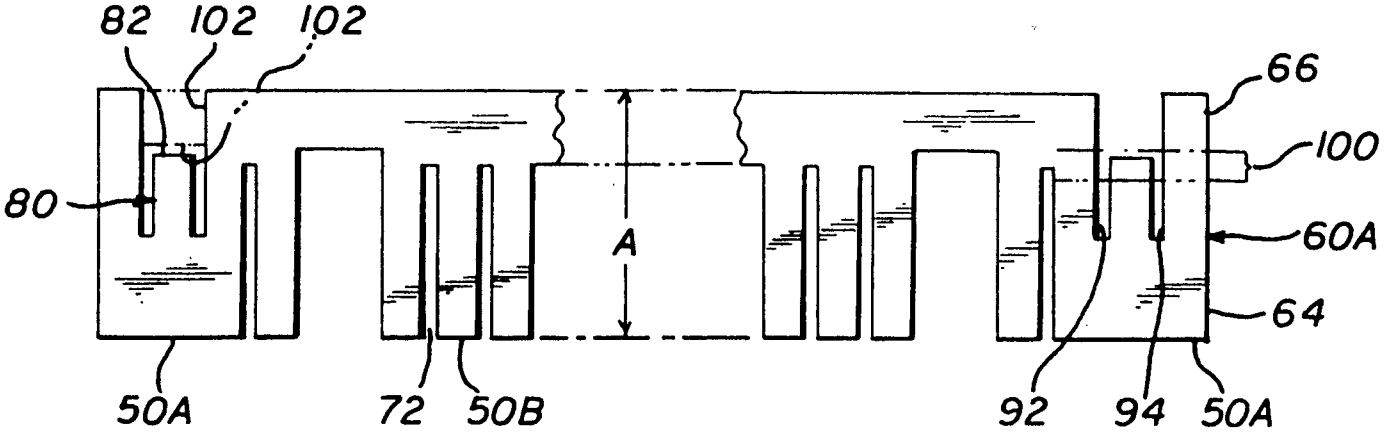
FIG. 4 is a front elevation view of the interference shield of FIG. 3, after blanking but before bending.
Figure 5:
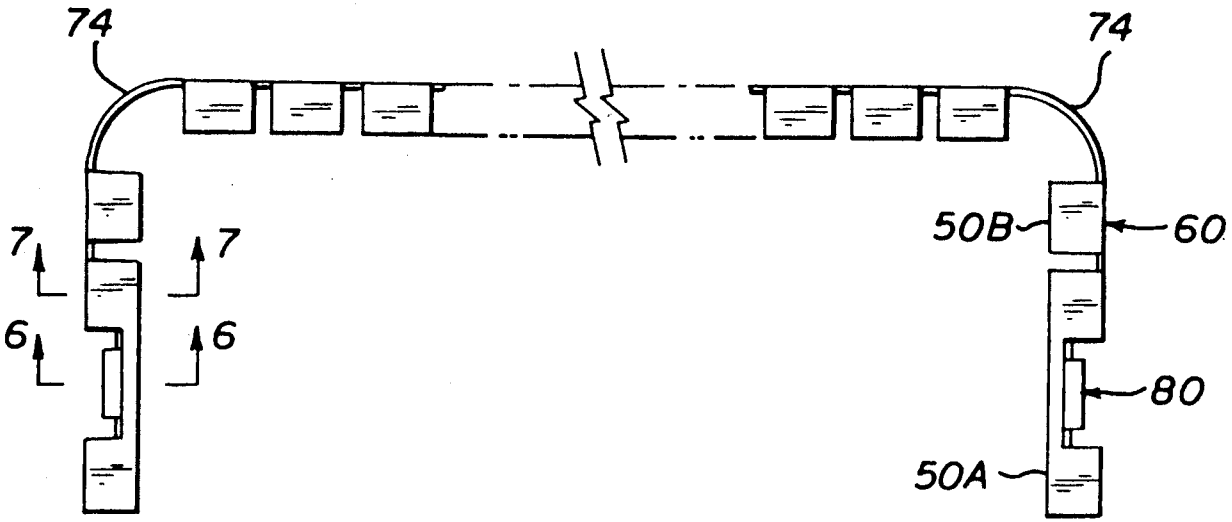
FIG. 5 is a plan view of the shield of FIG. 4, but after it has been bent to its final shape.

FIG. 4 illustrates a piece of sheet metal 60A which is to become the shield 60, with the sheet metal at 60A having been blanked from a larger sheet but not yet bent. The blanking results in multiple tine slots 72 that form multiple narrow tines 50B and a pair of wide tines 50A. The finger slots 92, 94 in each wide tine form one of the fingers 80. The particular shield 60A includes a cutout 102 that leaves the free forward end 82 of each finger. After the shield 60A is blanked, an approximately 180° bend 100 is formed so the tines extend primarily rearwardly. The formation of the bend results in the inner and outer legs 64, 66 both extending rearwardly from the bend. A next step, illustrated in FIG. 5, is to form the corner bend regions 74 in the outer leg, to conform with the curvature of the corners of the receptacle shell at the grooves. The result is the shield 60, which is ready to be installed.

FIG. 6 illustrates the manner in which the shield 60 is installed on the shell. The shell has inner and outer surfaces 104, 106, with the groove 70 being formed in the inner shell surface. A thin strip 110 of solder is laid in the groove and the outer leg 66 of the shield is placed in the groove and clamped in place. The shell with the shield clamped therein is then soldered in place as by placing the shell in a hot vapor which melts the solder.

It may be noted that the shield 60 shown in FIG. 5 can cover only three of the four sides of the shell. Such a shield is constructed because in the particular shell illustrated (FIG. 3) two corners of the shell have a flattened region 112 that makes it easier to use a separate shield 114 of similar construction but without forwardly extending fingers for grounding the plug connector.

In one receptacle connector that applicant has designed, which included 352 socket contacts, the shell had a length of 5.348 inches between its opposite short sides 36, 40 and a width of 0.583 inch. The shield 60 was constructed of beryllium copper with a nickel finish, of a total of 0.004 inch thickness. The shield had a height A (FIG. 4) in its unbent condition of 0.326 inch, with the tines having a height B (FIG. 7) of about 0.210 inch and extending at an angle of 5½° from parallelism with the connector axis. The fingers each had a height C (FIG. 6) of about 0.10 inch. The rearward end 90 of each finger was bent about 5° from the surrounding portion of the inner leg, so that the fingers extended directly in a forward direction F. It can be seen that the free end 82 of the finger includes about three quarters of the almost 180° bend 100 of the shield, with its extreme tip 112 lying directly under or outward of the shell opening 40.

Thus, the invention provides a receptacle connector with both EMI shielding and early grounding, in a low cost and reliable construction. A shield formed of sheet metal, has a bend forming an outer leg held to the inside of the connector shell and an inner leg with slots dividing it into tines. One of the tines is especially wide and includes at least one and preferably at least two slots that form an early grounding finger with a forward free end that is opposite the rearward free ends of the tines. The finger is bent so that it engages a plug shell before the contacts on the plug and receptacle mate.

Although particular embodiments of the invention have been described and illustrated herein, it is recognized that modifications and variations may readily occur to those skilled in the art, and consequently it is intended that the claims be interpreted to cover such modifications and equivalents.

I claim:

1. A receptacle connector for mating with a plug connector comprising:

a receptacle connector shell with an axis, said shell having an inside and an outside and having shell walls with inner and outer surfaces, said shell having a forward portion for receiving said plug connector and a rearward portion;

an insulative body lying at the inside of said shell;

a plurality of contacts mounted in said body and having forward mating ends;

an interference shield mounted on said shell, said shield being formed of a piece of sheet metal having a bend of about 180° and having outer and inner legs on opposite sides of said bend with said inner leg lying closer to said axis than said outer leg, said outer leg being mounted facewise against said inner surface of said shell with said forward end of said shield lying closer to said shell forward portion than to said shell rearward portion;

said inner leg having a forward portion with a first slot dividing said forward portion into first and second parts, with said first part of said inner leg merging with said outer leg along a portion of said bend, and with said second part forming a finger with a rear end supported on said first part and with a free forward end that is free of mechanical connection to said outer leg and to said first part and that is free to move outwardly and inwardly toward and away from an adjacent part of said shell, said finger being bent so said free end lies inward of an adjacent location on said first part, to engage said plug connector early during its insertion into said receptacle connector shell.

2. A method for constructing a connector comprising:

forming a shell with walls having inner and outer surfaces and a groove in the inner surface;

forming a piece of sheet metal with substantially parallel outer and inner opposite edges and with a plurality of tine slots in said inner edge forming a plurality of tines;

bending said piece of sheet metal by about 180° along a bend extending parallel to said sides and at substantially the inner end of said slots to form outer and inner legs with said inner leg forming said plurality of tines;

placing said outer leg in said shell groove and fixing it in place therein;

said step of forming a piece of sheet metal including forming at least two finger slots that extend primarily parallel to said tine slots but that have outer ends spaced from said outer edge to form a finger that is shorter than said tines, and separating the inner end of the finger from the rest of the sheet metal at about the location of said bend to leave a free finger end, and including bending said finger relative to an adjacent tine so said finger free end lies inward of adjacent portions of said tines.

3. The method described in claim 2 wherein:

said shell has a largely rectangular opening and has first and second perpendicular walls forming said groove, with said groove having a bent groove portion between said walls;

said step of forming said sheet metal includes leaving only a narrow width of said sheet metal lying near said outer edge along a bent shield region of said sheet metal, to leave only an outer leg therealong, and bending said bent region approximately 90. about an axis extending perpendicular to said edges;

said step of placing includes placing said bent shield region into said bent groove portion.

4. A receptacle connector comprising:

a shell with forward and rearward ends and having walls forming a forwardly facing substantially rectangular opening, said walls having inner and outer surfaces;

an insulative body mounted in said shell and holding a plurality of contacts;

a sheet metal interference shield mounted on said shell inner surface, said shield having inner and outer legs and a bend joining said legs, said outer leg mounted to said shell inner surface with said bend closest to said shell forward end;

said inner leg of said shield forming a finger of a height in forward and rearward directions which is less than the height of said inner leg, with the rearward end of the finger merging with the rest of the outer leg and with the finger having opposite sides and an upper end that are all free of attachment to the rest of said shield, and said finger being bent so its upper end lies inward of adjacent portions of said outer leg that are of the same height.

5. The connector described in claim 4 wherein:

said shield has a plurality of slots extending along substantially the entire height of said inner leg to its lower end to form a plurality of tines, a first of said tines having finger-forming slots forming said finger.

6. The connector described in claim 4 wherein:

said upper end of said finger extends at least half way around said bend.

7. A receptacle connector for mating with a plug connector comprising:

a receptacle connector shell with an inside and an outside and with shell walls having inner and outer surfaces, said shell having a forward portion for receiving said plug connector and a rearward portion;

an insulative body lying at the inside of said shell;

a plurality of contacts mounted in said body and having forward mating ends;

an interference shield mounted on said shell, said shield being formed of a piece of sheet metal having a bend of about 180° and having outer and inner legs on opposite sides of said bend, said outer leg being mounted facewise against said inner surface of said shell;

said inner leg having a forward portion with first and second slots dividing said forward portion into first, second, and third parts, with said first and second parts of said inner leg each merging with said outer leg along a portion of said bend, and with said second part lying between said first and third parts and forming a finger with a rear end supported on an least said first part and with a free forward end that is free of mechanical connection to said outer leg and that is free to move outwardly and inwardly toward and away from an adjacent part of said shell, said finger being bent so said free end lies inward of adjacent locations on said first and second parts, to engage said plug connector early during its insertion into said receptacle connector shell.

8. The connector described in claim 7 wherein:

said first and third parts of said inner leg merge rearward of said finger rear end, to form a tine, said shell has an axis along which said plug connector can move into said shell, and said tine extends rearwardly and with a directional component toward said axis.

9. A receptacle connector for mating with a plug connector comprising:

a receptacle connector shell with an inside and an outside and with shell walls having inner and outer surfaces, said shell having a forward portion for receiving said plug connector and a rearward portion, said forward portion having a largely rectangular forward end forming four sides with a wall at each side;

an insulative body lying at the inside of said shell;

a plurality of contacts mounted in said body and having forward mating ends;

an interference shield mounted on said shell, said shield being formed of a piece of sheet metal having a bend of about 180° and having outer and inner legs on opposite sides of said bend, said outer leg being mounted facewise against said inner surface of said shell;

said inner leg having a forward portion with a first slot dividing said forward portion into first and second parts, with said first part of said inner leg merging with said outer leg along a portion of said bend, and with said second part forming a finger with a rear end supported on said first part and with a free forward end that is free of mechanical connection to said outer leg and that is free to move outwardly and inwardly toward and away from an adjacent part of said shell, said finger being bent so said free end lies inward of an adjacent location on said first part, to engage said plug connector early during its insertion into said receptacle connector shell;

said shield has first and second regions that lie on at least two of said walls of said forward end that are adjacent, and said shield has a bent region between said first and second regions, said bent region having only said outer leg;

said shell walls each have a length dimension and the inside shell surface of said two adjacent walls each has a groove extending along its length, and said shell has a bent groove portion connecting said grooves of said two walls, with said shield regions lying in said grooves and soldered in place therein and with said shield bent region lying closely in said shell bent groove portion.

* * * * *